US011651880B2

(12) United States Patent
Yamashita

(10) Patent No.: US 11,651,880 B2
(45) Date of Patent: May 16, 2023

(54) COMPOSITE PARTICLE, CORE, AND INDUCTOR ELEMENT

(71) Applicant: TDK CORPORATION, Tokyo (JP)

(72) Inventor: Yasuhide Yamashita, Tokyo (JP)

(73) Assignee: TDK CORPORATION, Tokyo (JP)

( * ) Notice: Subject to any disclaimer, the term of this patent is extended or adjusted under 35 U.S.C. 154(b) by 369 days.

(21) Appl. No.: 16/827,950

(22) Filed: Mar. 24, 2020

(65) Prior Publication Data

US 2020/0312502 A1 Oct. 1, 2020

(30) Foreign Application Priority Data

Mar. 27, 2019 (JP) ..... JP2019-060954

(51) Int. Cl.

| | |
|---|---|
| ***H01F 1/20*** | (2006.01) |
| ***H01F 1/147*** | (2006.01) |
| ***H01F 27/255*** | (2006.01) |
| ***H01F 17/04*** | (2006.01) |
| ***H01F 41/02*** | (2006.01) |

(52) U.S. Cl.

CPC ..... *H01F 1/20* (2013.01); *H01F 1/14733* (2013.01); *H01F 1/14766* (2013.01); *H01F 17/04* (2013.01); *H01F 27/255* (2013.01); *H01F 41/0246* (2013.01); *Y10T 428/32* (2015.01)

(58) Field of Classification Search

None

See application file for complete search history.

(56) References Cited

U.S. PATENT DOCUMENTS

| | | | | |
|---|---|---|---|---|
| 6,136,265 | A | 10/2000 | Gay | |
| 10,410,774 | B2 * | 9/2019 | Kusawake | H01F 1/153 |
| 10,774,404 | B2 * | 9/2020 | Suetsuna | C22C 38/10 |
| 11,049,641 | B2 * | 6/2021 | Ohkubo | H01F 17/04 |
| 2014/0097377 | A1 * | 4/2014 | Igarashi | B22F 5/006 252/62.54 |
| 2014/0132383 | A1 | 5/2014 | Matsuura et al. | |
| 2016/0155550 | A1 * | 6/2016 | Ohkubo | H01F 1/24 336/233 |
| 2017/0209924 | A1 * | 7/2017 | Suetsuna | B22F 9/04 |
| 2018/0043431 | A1 | 2/2018 | Araki et al. | |
| 2018/0068771 | A1 * | 3/2018 | Nakazawa | B29C 43/003 |
| 2018/0261385 | A1 * | 9/2018 | Nakazawa | H01F 1/33 |
| 2019/0333666 | A1 * | 10/2019 | Nakamura | H01F 7/021 |
| 2019/0392978 | A1 * | 12/2019 | Matsuura | H01F 1/26 |
| 2020/0066437 | A1 * | 2/2020 | Lee | H01F 17/04 |
| 2021/0053115 | A1 * | 2/2021 | Takahashi | B22F 1/16 |
| 2021/0057139 | A1 * | 2/2021 | Takahashi | H01F 1/14766 |
| 2021/0129218 | A1 * | 5/2021 | Matsumoto | H01F 1/24 |
| 2021/0183566 | A1 * | 6/2021 | Ohkubo | H01F 1/26 |
| 2021/0304932 | A1 * | 9/2021 | Yoshidome | C22C 45/02 |

(Continued)

FOREIGN PATENT DOCUMENTS

| | | |
|---|---|---|
| CN | 108364766 A | 8/2018 |
| JP | 2005-243769 A | 9/2005 |

(Continued)

*Primary Examiner* — Kevin M Bernatz

(74) *Attorney, Agent, or Firm* — Oliff PLC

(57) ABSTRACT

A composite particle includes a large particle and binder particles. The large particle has a particle size of 10 μm to 50 μm. The binder particles are attached on the large particle and each have a particle size smaller than that of the large particle.

12 Claims, 5 Drawing Sheets

(56) References Cited

U.S. PATENT DOCUMENTS

| | | | | |
|---|---|---|---|---|
| 2021/0335526 | A1* | 10/2021 | Yamashita | H01F 1/344 |
| 2021/0391112 | A1* | 12/2021 | Yamashita | H01F 1/24 |

FOREIGN PATENT DOCUMENTS

| | | | |
|---|---|---|---|
| JP | 2016-180154 | A | 10/2016 |
| JP | 2018-152557 | A | 9/2018 |
| WO | 2012/147576 | A1 | 11/2012 |

* cited by examiner

COMPOSITE PARTICLE, CORE, AND INDUCTOR ELEMENT

BACKGROUND OF THE INVENTION

The present invention relates to a composite particle, such as a composite particle constituting a core.

As described in Patent Document 1, widely used as a coil-type electronic component is a core obtained by putting metal magnetic particles and a binder into a predetermined die and pressing them.

However, it is difficult to disperse the binder to the metal magnetic particles. As a result, the coil-type electronic component has a problem with characteristic variation after pressing.

Patent Document 1: WO2012147576 (A1)

BRIEF SUMMARY OF INVENTION

The present invention has been achieved under the above-mentioned problem. It is an object of the invention to provide composite particles with less characteristic variation after pressing and a core and an inductor element using the composite particles.

That is, an embodiment of the present invention is as follows.

[1] A composite particle includes:

a large particle having a particle size of 10 μm to 50 μm; and binder particles attached on the large particle and each having a particle size smaller than that of the large particle.

[2] The composite particle according to [1] further includes two or more small particles attached on the large particle and each having a particle size smaller than that of the large particle, wherein at least one of the binder particles is attached on the large particle and located between two small particles among the two or more small particles attached on the large particle.

[3] The composite particle according to [2], wherein the small particles are magnetic particles.

[4] The composite particle according to any of [1] to [3], wherein the large particle is a magnetic particle.

[5] The composite particle according to any of [2] to [4], wherein each of the binder particles has a particle size smaller than that of the small particles.

[6] The composite particle according to any of [1] to [5], wherein the binder particles are deposited and attached on the large particle.

[7] A core has a cross section or a surface on which the composite particle according to any of [1] to [6] is observed.

[8] An inductor element includes the core according to [7].

[9] A method of manufacturing composite particles includes the steps of:

preparing a first solution in which large particles each having a particle size of 10 μm to 50 μm are dispersed in a binder soluble solution in which a binder is dissolved;

preparing a second solution in which a binder insoluble solution is added to the first solution; and drying the second solution, wherein the binder soluble solution is soluble to the binder and the binder insoluble solution, and wherein the binder insoluble solution is insoluble to the binder.

[10] The method according to [9], wherein an aggregation inhibitor is added to the first solution in preparing the second solution.

[11] The method according to [9] or [10], wherein a small particle having a particle size smaller than that of each of the large particles is attached on each of the large particles in the first solution.

[12] Composite particles are obtained by the method according to any of [9] to [11].

DETAILED DESCRIPTION OF INVENTION

1. Inductor Element

Figure 1:
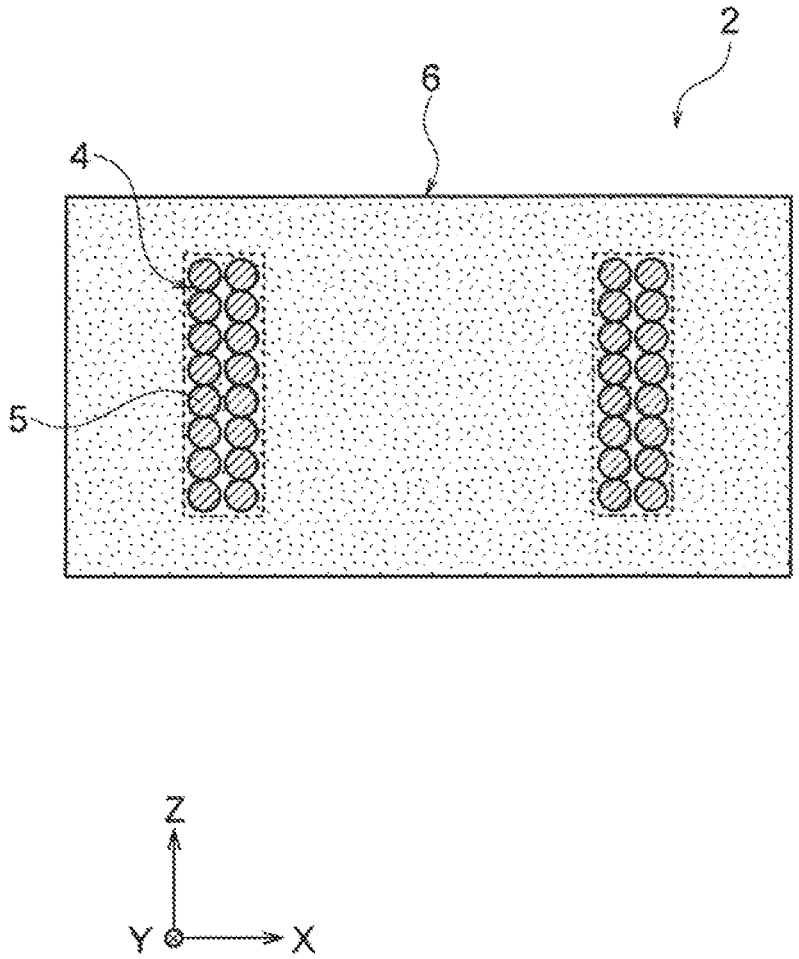
FIG. 1 is a cross-sectional view of an inductor element according to an embodiment of the present invention.

As shown in FIG. 1, an inductor element 2 according to an embodiment of the present invention includes a winding part 4 and a core 6. A conductor 5 is wound in coil manner in the winding part 4. The core 6 is formed from particles and a binder.

For example, the core 6 is formed by pressing the particles and the binder. The particles are united with the binder, and the core 6 thereby has a predetermined fixed shape.

Figure 2:
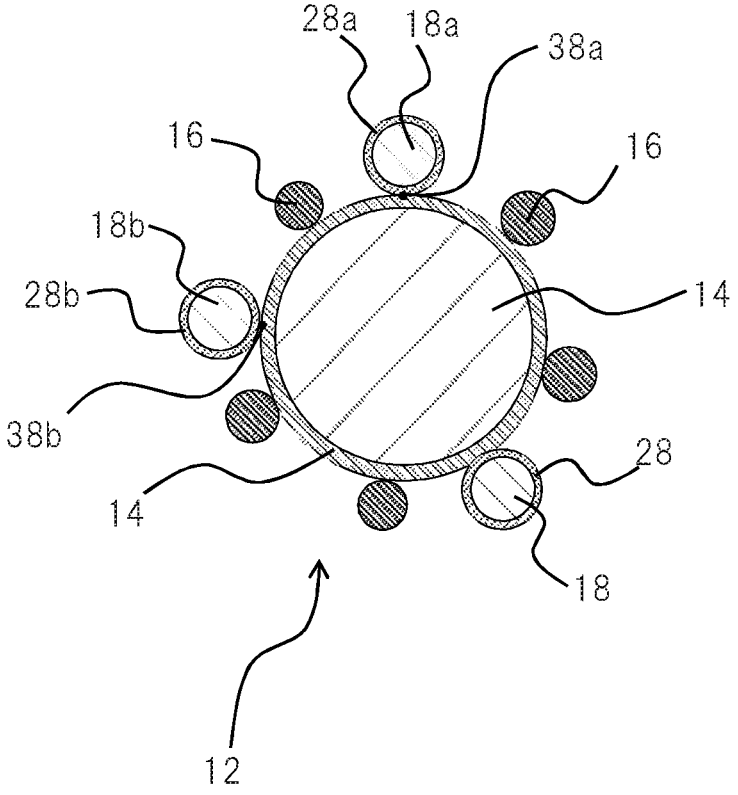
FIG. 2 is a schematic cross-sectional view of a composite particle according to an embodiment of the present invention.

In the present embodiment, the particles and the binder constituting the core 6 are at least partly formed from, for example, predetermined composite particles 12 shown in FIG. 2.

Preferably, the ratio of the predetermined composite particles 12 shown in FIG. 2 to the total of the particles and the binder constituting the core 6 (100 mass %) is 93 mass % to 99.5 mass %. This makes it possible to obtain the following effects ("less characteristic variation after pressing" and "high consistency between pressing pressure and withstand voltage of the core 6 after pressing") of the composite particles 12 according to the present embodiment.

1-1. Composite Particles

In each of the composite particles 12 according to the present embodiment, as shown in FIG. 2, small particles 18 and binder particles 16 are attached on a large particle 14. The large particle 14 has a particle size of 10 μm to 50 μm (preferably, 10 μm to 25 μm).

In the present embodiment, the binder particles 16 are attached on each of the large particles 14 and each located between two small particles 18*a* and 18*b* among the small particles 18 attached on each of the large particles 14.

Here, "the binder particles 16 are attached on each of the large particles 14 and each located between two small particles 18*a* and 18*b* among the small particles 18 attached on each of the large particles 14" means that the binder particles 16 are attached on each of the large particles 14 and each located between connection points 38*a* and 38*b* of the two adjacent small particles 18*a* and 18*b* and each of the large particles 14.

Although explained below, each of the large particles 14 shown in FIG. 1 may include a cover part 24, and the small particles 18*a* and 18*b* may also include a cover part 28. In this case, strictly speaking, the connection point 38*a* between the small particle 18*a* and the large particle 14 mentioned above thereby means the connection point 38*a* between the cover part 28*a* of the small particle 18*a* and the cover part 24 of the large particle 14, and the connection point 38*b* between the small particle 18*b* and the large particle 14 thereby means the connection point 38*b* between the cover part 28*b* of the small particle 18*b* and the cover part 24 of the large particle 14.

The number of binder particles 16 attached on each of the large particles 14 and each located between the two small particles 18*a* and 18*b* attached on each of the large particles 14 is not limited, but is preferably one or more (more preferably, six or more). This makes it possible to obtain the composite particles 12 where the binder particles 16 are dispersed for each of the large particles 14.

The particle size of the binder particles 16 attached on each of the large particles 14 and each located between the two small particles 18*a* and 18*b* attached on each of the large particle 14 is not limited, but is smaller than that of each of the large particles 14 and each of the small particles 18 and is preferably 0.1 μm to 10 μm (more preferably, 1 μm to 7.5 μm). This makes it possible to obtain the composite particles 12 where the binder particles 16 are dispersed for each of the large particles 14.

The number of small particles 18 attached on each of the large particles 14 is not limited, but is six or more, for example.

Preferably, each of (dL/dS), (dL/dB), and (dS/dB) satisfies the following relation, where dL is a particle size of the large particle 14, dS is a particle size of the small particle 18 attached on the large particle 14, and dB is a particle size of the binder particle 16 attached on the large particle 14.

That is, preferably, $1 \leq (dL/dS) \leq 25$. More preferably, $1.4 \leq (dL/dS) \leq 8.3$.

Preferably, $1 \leq (dL/dB) \leq 500$. More preferably, $2 \leq (dL/dB) \leq 25$.

Preferably, $0.6 \leq (dS/dB) \leq 200$. More preferably, $1.0 \leq (dS/dB) \leq 7.0$.

Figure 3:
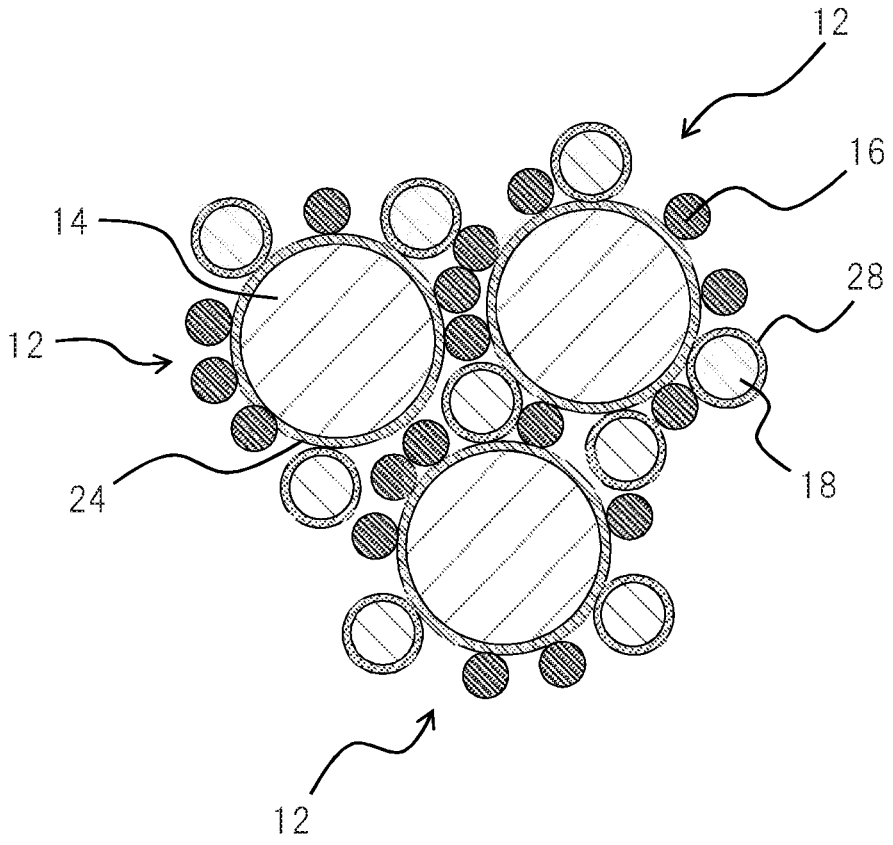
FIG. 3 is a schematic cross-sectional view of composite particles according to an embodiment of the present invention.

Incidentally, two or more composite particles 12 may aggregate as shown in FIG. 3.

The core 6 may conventionally be obtained by mixing a binder solution and the large particles 14 attached with the small particles 18, volatilizing the binder solution without depositing binder particles, and pressing these granules. Instead, the core 6 may conventionally be obtained by spraying a binder solution against the large particles 14 attached with the small particles 18, volatilizing the solvent of the binder solution, and pressing these granules.

Figure 4:
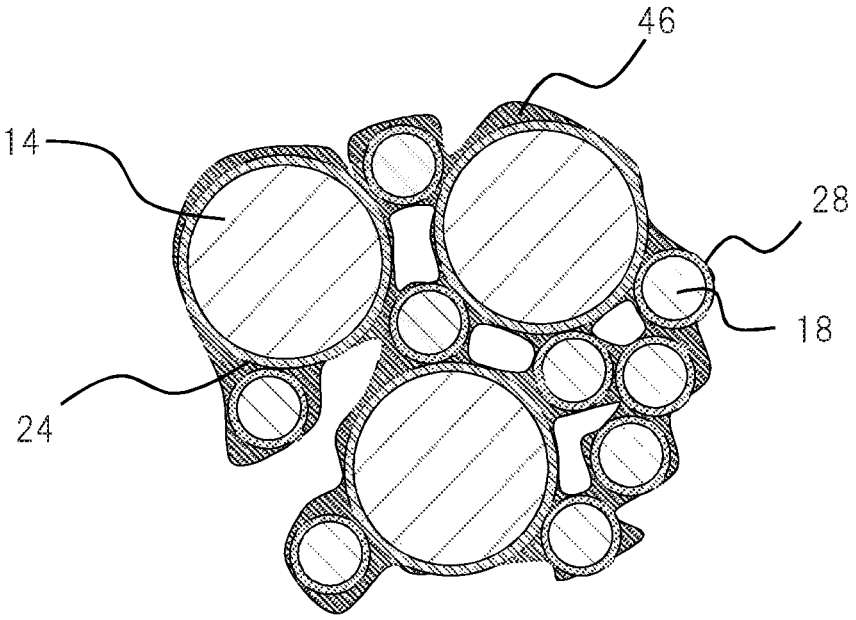
FIG. 4 is a schematic cross-sectional view of granules according to a comparative example of the present invention.

In these granules, however, as shown in FIG. 4, a binder 46 unevenly unites the large particles 14 and the small particles 18 and is uneven in thickness among the particles and is not dispersively attached on the large particles 14.

In these granules, the small particles 18 may aggregate and separate from the large particles 14 due to attraction of the small particles 18 by the binder 46. As a result, the arrangement of the large particles 14 and the small particles 18 may change, and there is a problem with difficulty in obtaining desired characteristics.

On the other hand, since the composite particles 12 according to the present embodiment have the above-mentioned structure, the small particles 18 and the binder particles 16 are dispersively attached on the large particles 14.

In the core 6 manufactured using the composite particles 12 according to the present embodiment, the binder is uniformly present for the large particles 14 and the small particles 18. Thus, the core 6 manufactured using the composite particles 12 according to the present embodiment has less characteristic variation after pressing.

In the manufacture of the core 6 using the composite particles 12 according to the present embodiment, there is a high consistency between pressing pressure and withstand voltage of the core 6 after pressing. Specifically, the higher pressing pressure is, the higher withstand voltage is. Thus, when the consistency between pressing pressure and withstand voltage is high, it is possible to obtain a desired withstand voltage based on pressing pressure and to stably adjust withstand voltage characteristics (product characteristics).

1-1-1. Large Particles

In the present embodiment, the large particles 14 are magnetic particles. The inductor element 2 can be obtained by manufacturing the core 6 using the large particles 14.

The magnetic particles of the large particles 14 are preferably metal magnetic particles or ferrite particles, more preferably metal magnetic particles. Still more preferably, the magnetic particles of the large particles 14 contain Fe.

Specifically, the metal magnetic particles containing Fe are pure iron, carbonyl Fe, Fe based alloy, Fe—Si based alloy, Fe—Al based alloy, Fe—Ni based alloy, Fe—Si—Al based alloy, Fe—Si—Cr based alloy, Fe—Co based alloy, Fe based amorphous alloy, Fe based nanocrystalline alloy, etc. Preferably, the metal magnetic particles containing Fe are Fe—Si based alloy.

The ferrite particles are Mn—Zn, Ni—Cu—Zn, etc.

In the present embodiment, the large particles 14 may be structured by a plurality of large particles composed of the same material or a plurality of mixed large particles composed of different materials. For example, multiple Fe based alloy particles and multiple Fe—Si based alloy particles may be mixed and used for the large particles 14.

Each of the large particles 14 according to the present embodiment has a particle size of 10 μm to 50 μm (preferably, 20 μm to 25 μm).

Incidentally, the above-mentioned particle size excludes the cover part 24 of each of the large particles 14 mentioned below.

When the large particles 14 are structured by large particles composed of two or more types of different materials, the large particles composed of a certain material and the large particles composed of another material may have different particle sizes.

Incidentally, for example, the different materials mean that elements constituting metal or alloy are different from each other or that elements constituting metal or alloy are the same but have different compositions.

1-1-2. Small Particles

In the present embodiment, the small particles 18 are magnetic particles. When the core 6 is manufactured using the small particles 18, the core 6 has a higher packing density, and the inductor element 2 having a higher withstand voltage can be obtained.

The magnetic particles used for the small particles 18 are preferably metal magnetic particles or ferrite particles (more preferably, metal magnetic particles). Still more preferably, the magnetic particles used for the small particles 18 contain Fe.

Specifically, the metal magnetic particles containing Fe are pure iron, carbonyl Fe, Fe based alloy, Fe—Si based alloy, Fe—Al based alloy, Fe—Ni based alloy, Fe—Si—Al based alloy, Fe—Si—Cr based alloy, Fe—Co based alloy, Fe based amorphous alloy, Fe based nanocrystalline alloy, etc. Preferably, the metal magnetic particles containing Fe are carbonyl Fe.

The ferrite particles are Mn—Zn, Ni—Cu—Zn, etc.

In the present embodiment, the small particles 18 may be structured by a plurality of small particles composed of the same material or a plurality of mixed small particles composed of different materials. For example, carbonyl Fe and multiple Fe—Si based alloy particles may be mixed and used for the small particles 18.

In the present embodiment, the large particles 14 and the small particles 18 may be composed of the same material or different materials.

Preferably, each of the small particles 18 according to the present embodiment has a particle size of 2 μm to 20 μm (more preferably, 3 μm to 7 μm).

Incidentally, the above-mentioned particle size excludes the cover part 28 of each of the small particles 14 mentioned below.

When the small particles 18 are structured by small particles composed of two or more types of different materials, the small particles 18 composed of a certain material and the small particles 18 composed of another material may have different particle sizes.

Incidentally, for example, the different materials mean that elements constituting metal or alloy are different from each other or that elements constituting metal or alloy are the same but have different compositions.

1-1-3. Cover Part

In the present embodiment, a cover part may be formed on at least a part of each of the large particles 14 and the small particles 18. In the manufacturing steps of the core 6, the large particles 14 and the small particles 18 may contact with water. Thus, the cover part can prevent oxidation. If the large particles 14 or the small particles 18 are united with each other or the large particles 14 and the small particles 18 are united directly, magnetic characteristics (e.g., DC bias characteristic, withstand voltage characteristics) may be affected. Thus, grain boundaries are preferably formed by the cover part.

The cover part is composed of any materials of TEOS, MgO, glass, resin, phosphates (e.g., zinc phosphate, calcium phosphate, iron phosphate), or the like.

Incidentally, the cover parts 24 of the large particles 14 are preferably composed of TEOS. This makes it possible to maintain a high withstand voltage of the core.

Preferably, the cover parts 28 of the small particles 18 are preferably composed of MgO. This makes it possible to maintain high withstand voltage characteristics and a high corrosion resistance.

In the present embodiment, covering the large particle 14 and the small particles 18 with a material means that this material contacts with the large particle 14 and the small particles 18 and is fixed to cover this contact area.

The cover part covering the large particle 14 and the small particles 18 needs to at least partly cover the large particle 14 and the small particles 18, but preferably covers the entire surface of each of the large particle 14 and the small particles 18. Moreover, the cover part may continuously or intermittently cover each of the large particle 14 and the small particles 18.

Incidentally, none of the large particles 14 and the small particles 18 may have the cover part. For example, 50% or more of the large particles 14 and 50% or more of the small particles 18 may have the cover part.

1-1-4. Binder

Known resins can be used as a resin to be a binder constituting the core 6 (i.e., a resin to be the binder particles 16 of each of the composite particles 16). Specifically, this resin is epoxy resin, phenol resin, polyimide resin, polyamide imide resin, silicone resin, melamine resin, urea resin, furan resin, alkyd resin, unsaturated polyester resin, diallyl phthalate resin, etc. and is preferably epoxy resin. The resin to be the binder particles 16 may be thermosetting resin or thermoplastic resin, but is preferably thermosetting resin.

2. Method of Manufacturing Core

In the present embodiment, the core 6 is manufactured using the above-mentioned composite particles 12. Thus, a method of manufacturing the composite particles 2 is initially explained, and a method of manufacturing the core 6 using the composite particles 12 is thereafter explained.

2-1. Method of Manufacturing Composite Particles

A method of manufacturing the composite particles 12 according to the present embodiment includes: a step of preparing a first solution in which the large particles 14 are dispersed in a binder soluble solution in which a binder is dissolved; a step of preparing a second solution in which a binder insoluble solution is added to the first solution; and a step of drying the second solution.

First, the large particles 14 and the small particles 18 are prepared.

The large particles 14 and the small particles 18 may have a cover part. The cover part is formed on each of the large particles 14 and the small particles 18 by any known method. For example, the cover part can be formed by subjecting the large particles 14 and the small particles 18 to a wet processing.

Specifically, the large particles 14 and the small particles 18 are immersed into a solution in which compounds, their precursors, etc. to be constituting the cover part are dissolved, or this solution is sprayed against the large particles 14 and the small particles 18. Then, the large particles 14 and the small particles 18 attached with this solution are subjected to a heat treatment. This makes it possible to form the cover part on each of the large particles 14 and the small particles 18.

Next, the small particles 18 each having the cover part are attached on the large particles 14 each having the cover part in any manner. For example, the small particles 18 may be attached on the large particles 14 by electrostatic attraction, mechanochemical method, or synthetic deposition.

In order that the binder particles 16 are attached on each of the large particles 14 and located between two small particles 18*a* and 18*b* among the small particles 18 attached on each of the large particles 14, the two small particles 18*a* and 18*b* need to be away from each other to some degree. From this point of view, the small particles 18 are preferably attached on each of the large particles 14 by electrostatic attraction. This is because, for electrostatic attraction, the large particles 14 and the small particles 18 are oppositely electrically charged and thereafter attracted, and the amount of the small particles 18 attached on each of the large particles 14 can thereby be controlled.

In the present embodiment, D90 of the small particles 18 is preferably smaller than D10 of the large particles 14.

Here, D10 is a particle size of a particle whose cumulative frequency is 10%, counting from the smaller particle size.

D90 is a particle size of a particle whose cumulative frequency is 90%, counting from the smaller particle size.

Incidentally, particle size distribution (e.g., D10, D90) can be measured by particle size distribution measuring machine, such as laser diffraction particle size distribution analyzer HELOS (Japan Laser Corporation).

The large particles 14 attached with the small particles 18 obtained in such a manner and a binder soluble solution are mixed.

Here, the binder soluble solution is a solution that is soluble to a binder insoluble solution and a binder to be added in the next step.

For example, when the binder to be added in the next step is a binder whose SP value is 10-15, such as epoxy resin (SP value: 10.9) and phenolic resin (SP value: 11.3), the binder soluble solution is a solvent whose SP value is 9.3-11, such as acetone (SP value: 9.9) and methyl ethyl ketone (SP value: 9.3).

The total concentration of the large particles 14 and the small particles 18 in the first solution is not limited (e.g., 10 mass % to 80 mass %). This makes it easier to attach the binder particles 16 onto each of the large particles 14 in the following steps.

Next, a first solution is prepared by adding the binder to the binder soluble solution containing the large particles 14 in any manner. For example, the binder can be added to the binder soluble solution containing the large particles 14 after binder solids are dissolved in the above-mentioned binder soluble solution.

In the first solution, the binder solid content is preferably 0.7 parts by mass to 4 parts by mass with respect to 100 parts by mass of the total of the large particles 14 and the small particles 18. This makes it easier to attach the binder particles 16 onto each of the large particles 14 in the following steps.

Next, the second solution is prepared by adding a binder insoluble solution to the first solution.

Here, the binder insoluble solution is a solution that is insoluble to the binder added in the previous step and is soluble to the binder soluble solution.

For example, when the binder soluble solution employed in the above-mentioned step is a solvent whose SP value is 9.3-11 (e.g., acetone) and the binder added in the above-mentioned step is epoxy resin, the binder insoluble solution can be water (SP value: 23.4), ethanol (SP value: 12.7), or the like.

The second solution is prepared by adding the binder insoluble solution to the first solution, and the binder soluble solution is thereby dissolved in the binder insoluble solution. Thus, the binder dissolved in the binder soluble solution can be deposited as binder particles 16. Due to the deposition of the binder as the binder particles 16, the binder particles 16 can uniformly attach on each of the large particles 14 in the next step.

When the binder insoluble solution is added to the first solution, this mixture may be stirred in a lightly shaking manner.

The addition amount of the binder insoluble solution is not limited, but is preferably, for example, 15 parts by mass to 50 parts by mass with respect to 100 parts by mass of the binder soluble solution.

Then, an aggregation inhibitor is added to the second solution. The aggregation inhibitor is ethanol, IPA, or the like. This adjusts surface tension of the second solution and makes it possible to prevent the aggregation of the composite particles 12 in drying the second solution in the following step. In addition, the aggregation inhibitor can achieve a further higher consistency between pressing pressure and withstand voltage.

Preferably, 10 parts by mass to 50 parts by mass of the aggregation inhibitor are added with respect to 100 parts by mass of the binder soluble solution.

Next, the second solution added with the aggregation inhibitor is dried. This allows the deposited binder particles 16 to attach on each of the large particles 14 and makes it possible to obtain the composite particles 12 where the binder particles 16 are deposited on each of the large particles 14. Preferably, each of the binder particles 16 according to the present embodiment has a particle size of 0.1 μm to 10 μm (more preferably, 1 μm to 5 μm). This makes it possible to obtain the composite particles 12 where the binder particles 16 are dispersed to each of the large particles 14.

The second solution added with the aggregation inhibitor is dried with any conditions and is dried, for example, for 30 minutes to 2 hours at (Tb−30)° C. to Tb° C., where Tb is higher one of a boiling point of the binder soluble solution and a boiling point of the binder insoluble solution.

2-2. Method of Manufacturing Core

As shown in FIG. 1, the above-mentioned composite particles 12 and an air-core coil formed by winding a conductor (wire) 5 with a predetermined number are put into a die and pressed to obtain a green compact where the coil is embedded. The composite particles 12 and the air-core coil are pressed in any manner (e.g., unidirectionally, isotropically with WIP, CIP, etc.), but are preferably pressed isotropically. This makes it possible to achieve rearrangement of the large particles 14 and the small particles 18 and densification of internal organization.

The obtained green compact is heated to obtain the core 6 having a predetermined shape where the large particles 14 and the small particles 18 are fixed, and the coil is embedded. Since the coil is embedded in the core 6, the core 6 functions as a coil type electronic component like the inductor element 2.

3. Summary of Present Embodiment

The present embodiment explained above is directed to the composite particle 12 including the large particle 14 having a particle size of 10 μm to 50 μm and the binder particles 16 attached on the large particle 14 and each having a particle size smaller than that of the large particle 14.

The composite particles 12 have less characteristic variation after pressing. Specifically, a binder is uniformly present to the large particle 14 in the core 6 manufactured using the composite particles 12 according to the present embodiment.

When the core 6 is manufactured using the composite particles 12 according to the present embodiment, the consistency between pressing pressure and withstand voltage of the core 6 after pressing becomes high. Specifically, the higher pressing pressure is, the higher withstand voltage becomes. When the consistency between pressing pressure and withstand voltage of the core 6 after pressing becomes high, it is possible to obtain a desired withstand voltage based on pressing pressure and to stably adjust withstand voltage characteristics (product characteristics).

As a specific mode of the present embodiment, it is permissible to employ the composite particle 12 further including two or more small particles 18 attached on the large particle 14 and each having a particle size smaller than that of the large particle 14, wherein the binder particles 16 are present on the large particle 14 and located between two small particles 18*a* and 18*b* among the small particles 18 attached on the large particle 14.

When the core 6 is manufactured using the composite particles 12, the packing density of the core 6 is increased, and withstand voltage characteristics are further improved.

As a specific mode of the present embodiment, it is permissible to employ the composite particles 12, wherein the small particles 18 are magnetic particles.

The inductor element 2 can be manufactured with the core 6 using these composite particles 12.

As a specific mode of the present embodiment, it is permissible to employ the composite particle 12, wherein the large particle 14 is a magnetic particle.

The inductor element 2 can be manufactured with the core 6 using these composite particles 12.

As a specific mode of the present embodiment, it is permissible to employ the composite particle 12, wherein each of the binder particles 16 has a particle size smaller than that of the small particles 18.

This composite particle 12 has further less characteristic variation after pressing.

When the core 6 is manufactured using the composite particles 12 according to the present embodiment, the consistency between pressing pressure and withstand voltage of the core 6 after pressing becomes further higher.

As a specific mode of the present embodiment, it is permissible to employ the composite particles 12, wherein the binder particles 16 are deposited and attached on the large particle 14.

Since the size and number of these binder particles 16 attached on the large particle 14 are controlled, the composite particle 12 has further less characteristic variation after pressing.

When the core 6 is manufactured using the composite particles 12 according to the present embodiment, the consistency between pressing pressure and withstand voltage of the core 6 after pressing becomes further higher.

The present embodiment is directed to the core 6 having a cross section or a surface on which the above-mentioned composite particle 12 is observed.

In the core 6 manufactured using the composite particles 12 according to the present embodiment, a binder is uniformly dispersed to each of the large particles 14. Thus, the core 6 manufactured with the composite particles 12 according to the present embodiment has less characteristic variation after pressing.

When the core 6 is manufactured using the composite particles 12 according to the present embodiment, the consistency between pressing pressure and withstand voltage of the core 6 after pressing becomes high.

Moreover, the present embodiment is directed to the inductor element 2 including the above-mentioned core 6.

In the core 6 manufactured using the composite particles 12 according to the present embodiment, the binder is uniformly present to the large particle 14. Thus, the core 6 manufactured using the composite particles 12 according to the present embodiment has less characteristic variation after pressing. Thus, the inductor element 2 having less characteristic variation can be obtained using the core 6.

When the core 6 is manufactured using the composite particles 12 according to the present embodiment, the consistency between pressing pressure and withstand voltage of the core 6 after pressing becomes high. Thus, using the core 6 makes it possible to obtain the inductor element 2 having stably adjust withstand voltage characteristics (product characteristics).

Moreover, the present embodiment is directed to a method of manufacturing composite particles. The method includes the steps of: preparing a first solution in which large particles having a particle size of 10 μm to 50 μm are dispersed in a binder soluble solution in which a binder is dissolved; preparing a second solution in which a binder insoluble solution is added to the first solution; and drying the second solution, wherein the binder soluble solution is soluble to the binder and the binder insoluble solution, and wherein the binder insoluble solution is insoluble to the binder.

The composite particles 12 obtained by the method have less characteristic variation after pressing.

The consistency between pressing pressure and withstand voltage of the core 6 after pressing becomes high by manufacturing the core 6 using the composite particles 12 according to the present embodiment.

As a specific mode of the present embodiment, it is permissible to employ the method of manufacturing the composite particles 12, wherein an aggregation inhibitor is added to the first solution in preparing the second solution.

This method adjusts surface tension of the second solution and makes it possible to prevent aggregation of the composite particles 12 in drying the second solution. Thus, the consistency between pressing pressure and withstand voltage of the core 6 after pressing becomes high by manufacturing the core 6 using the composite particles 12 according to the present embodiment.

As a specific mode of the present embodiment, it is permissible to employ the method of manufacturing the composite particles 12, wherein a small particle 18 having a particle size smaller than that of each of the large particles 14 is attached on each of the large particles 14 in the first solution.

This method increases the packing density of the core 6 and further improves withstand voltage characteristics.

Moreover, the present embodiment is directed to composite particles 12 obtained by the above-mentioned method.

The composite particles 12 obtained by the method have less characteristic variation after pressing.

The consistency between pressing pressure and withstand voltage of the core 6 after pressing becomes high by manufacturing the core 6 using the composite particles 12 according to the present embodiment.

Hereinbefore, an embodiment of the present invention is explained, but the present invention is not limited to the above-mentioned embodiment and may be modified in various embodiments within the scope of the present invention.

For example, the inductor element 2 has a structure where an air-core coil formed by winding the conductor 5 is embedded in the core 6 having a predetermined shape shown in FIG. 1, but may have any other structure as long as the conductor is wound on the core having a predetermined shape.

For example, the core may have a FT shape, an ET shape, an EI shape, a UU shape, an EE shape, an EER shape, a UI shape, a drum shape, a toroidal shape, a pot shape, a cup shape, or the like.

For example, the composite particles 12 according to the above-mentioned embodiment contain the small particles 18, but the small particles 18 may not necessarily be contained in the composite particles 12.

In this case, the number of binder particles 16 attached on each of the large particles 14 is preferably one or more (more preferably, six or more). This makes it possible to obtain the composite particles 12 where the binder particles 16 are dispersed to each of the large particles 14.

In this case, the particle size of each of the binder particles 16 attached on each of the large particles 14 is smaller than that of each of the large particles 14 and is preferably 0.1 μm to 10 μm (more preferably, 1 μm to 5 μm). This makes it possible to obtain the composite particles 12 where the binder particles 16 are dispersed to each of the large particles 14.

In the above-mentioned embodiment, each of the large particles 14 has the cover part 24, and each of the small particles 18 has the cover part 28. However, the large particles 14 and the small particles 18 may have no cover part.

In the above-mentioned embodiment, the first solution is prepared by adding a binder to the binder soluble solution containing the large particles 14, but the first solution may be formed by adding the large particles 14 to the binder soluble solution containing a binder.

In the above-mentioned embodiment, an aggregation inhibitor is added to the second solution after it is formed, but the aggregation inhibitor may be added in preparing the second solution. That is, the second solution may be prepared by adding the binder insoluble solution after the aggregation inhibitor is added to the first solution, or the second solution may be prepared by simultaneously adding the aggregation inhibitor and the binder insoluble solution to the first solution.

In the above-mentioned embodiment, the composite particles 12 used for the core 6 are explained. However, the composite particles 12 according to the present invention are used not only for the core 6, but for products containing particles and binder, such as paste products (e.g., dielectric paste, electrode paste), bonded magnets formed by mixing magnetic powder and binder, and polymer solid electrolyte formed by mixing lithium ion conductive solid electrolyte material and binder. In addition, the composite particles 12 according to the present invention can be used for magnetic shield sheets.

When the composite particles 12 according to the present invention is used for dielectric paste, the large particles 14 are composed of barium titanate, calcium titanate, strontium titanate, etc., and the small particles 18 are composed of silicon, rare earth element, alkaline earth metal, etc.

When the composite particles 12 according to the present invention are used for electrode paste, the large particles 14 are composed of Ni, Cu, Ag, Au, their alloys, etc.

Moreover, the large particles 14 are composed of any material. The large particles 14 may be composed of magnetic particles as explained in the above-mentioned embodiment or ceramics (e.g., barium titanate), Ni, etc. as mentioned above. Besides, the large particles 14 may be composed of alumina, polymer (epoxy, PPS, PES, PS, PMMA, Pa), etc.

The small particles 18 are also composed of any material. The small particles 18 may be composed of magnetic particles as explained in the above-mentioned embodiment or silicon etc. as mentioned above. Besides, the small particles 18 may be composed of alumina, ceramics (e.g., barium titanate), polymer (epoxy, PPS, PES, PS, PMMA, Pa), etc.

EXAMPLES

Hereinafter, the present invention is explained in more detail with Examples, but is not limited thereto.

Example 1

Large particles 14 attached with small particles 18 by electrostatic attraction were prepared.

The material of the large particles 14 was Fe—Si based alloy. The average particle size of the large particles 14 was 30 μm. A cover part 24 was formed on each of the large particles 14. The material of the cover parts 24 of the large particles 14 was TEOS.

The material of the small particles 18 was carbonyl Fe. The average particle size of the small particles 18 was 4.0 μm. A cover part 28 was formed on each of the small particles 18. The material of the cover parts 28 of the small particles 18 was MgO.

Next, an acetone was prepared as a binder soluble solution. The large particles 14 attached with the small particles 18 and the acetone were mixed and dispersed so that the total concentration of the large particles 14 and the small particles 18 would be 33 mass %.

Then, a binder solution (binder solid: epoxy resin, binder solid concentration: 33 mass %) was added to the liquid mixture to prepare a first solution. In the first solution, the binder solid content was 2 parts by weight to 100 parts by weight of the total of the large particles 14 and the small particles 18.

Next, a water was prepared as a binder insoluble solution. 7.5 parts by mass of the water were added to 100 parts by mass of the acetone contained in the first solution to prepare a second solution.

Then, an ethanol (aggregation inhibitor) was added to the second solution. 7.5 parts by mass of the ethanol were added to 100 parts by mass of the acetone.

Next, the second solution added with the ethanol was dried at 70° C. to 100° C. for one hour to obtain composite particles 12.

The composite particles 12 obtained in such a manner were filled in a predetermined rectangular-parallelepiped die where a predetermined insertion member was disposed. The predetermined insertion member was a conductor 5 having a winding part 4 (inner diameter: 4 mm, height: 3 mm). The die was set at 80° C. and pressed unidirectionally at 400 MPa (pressing pressure) to obtain a green compact of a core 6. The green compact of the manufactured core 6 was subjected to a heat hardening treatment at 200° C. for five hours in the air to obtain a rectangular-parallelepiped core 6 (length: 7 mm, width: 7 mm, height: 5.4 mm).

The number of cores 6 manufactured was three.

Incidentally, it was confirmed that none of the particle size of each of the large particles 14, the particle size of each of the small particles 18, the mixing ratio of the large particles 14, the mixing ratio of the small particles 18, and the mixing ratio of the binder 16 changed in the above-mentioned manufacturing steps.

Voltage was applied between terminal electrodes of the rectangular-parallelepiped core 6 using a DC Power Supply manufactured by KEYSIGHT and an LCR meter, and a voltage when 0.5 mA (electric current) flowed was determined to be a withstand voltage. This measurement was carried out for each of the three rectangular-parallelepiped cores 6.

Examples 2-4

Except for changing the pressing pressure as described in Table 1, rectangular-parallelepiped cores 6 were obtained to measure a withstand voltage as with Example 1.

Comparative Example 1

Large particles 14 attached with small particles 18 by electrostatic attraction were prepared. The material and the average particle size of the large particles 14 and the small particles 18 and the materials of the cover parts were the same as those of Example 1.

The large particles 14 attached with the small particles 18 and an epoxy resin solution (solvent:acetone) were mixed. The solid content of the epoxy resin was 2 parts by mass to 100 parts by mass of the total of the large particles 14 and the small particles 18. After the mixing, the acetone was volatilized to obtain granules.

Except for using the granules obtained in such a manner, a rectangular-parallelepiped magnetic material of Comparative Example 1 was obtained to measure a withstand voltage as with Example 1. The results are shown in Table 2.

Comparative Examples 2-4

Except for changing the pressing pressure as described in Table 2, rectangular-parallelepiped cores 6 of Comparative Examples 2-4 were obtained to measure a withstand voltage as with Comparative Example 1. The results are shown in Table 2.

TABLE 1

| Sample No. | Pressing Pressure [MPa] | Withstand Voltage [kV] |
|---|---|---|
| Example 1 | 400 | 0.47 |
| | | 0.46 |
| | | 0.47 |
| Example 2 | 600 | 0.52 |
| | | 0.52 |
| | | 0.52 |
| Example 3 | 800 | 0.55 |
| | | 0.52 |
| | | 0.54 |
| Example 4 | 1000 | 0.63 |
| | | 0.61 |
| | | 0.62 |

TABLE 2

| Sample No. | Pressing Pressure [MPa] | Withstand Voltage [kV] |
|---|---|---|
| Comparative Example 1 | 400 | 0.62 |
| | | 0.59 |
| | | 0.61 |
| Comparative Example 2 | 600 | 0.45 |
| | | 0.47 |
| | | 0.46 |
| Comparative Example 3 | 800 | 0.38 |
| | | 0.46 |
| | | 0.42 |
| Comparative Example 4 | 1000 | 0.47 |
| | | 0.35 |
| | | 0.42 |

Figure 5:
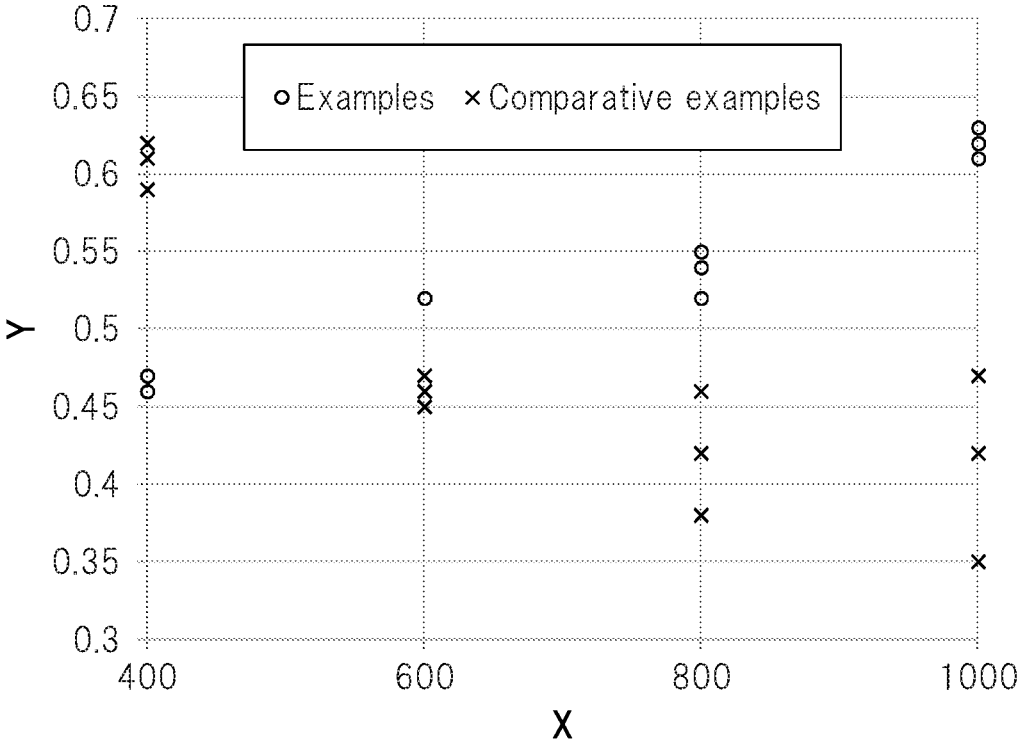
FIG. 5 is a graph relating to Examples 1-4 and Comparative Examples 1-4 of the present invention.

FIG. 5 is a graph made based on Table 1 and Table 2. In FIG. 5, the X-axis means withstand voltage, and the Y-axis means pressing pressure. "Examples" corresponds to Examples 1-4, and "Comparative Examples" corresponds to Comparative Examples 1-4.

FIG. 5 shows that the cores manufactured using the predetermined composite particles (Examples) had less variation in withstand voltage in the samples even though the pressing pressure was high compared to the cores manufactured using the granules prepared by the method of Comparative Examples (hereinafter, referred to as "comparative-example granules"). That is, FIG. 5 shows that the cores manufactured using the predetermined composite particles (Examples) had less variation in withstand voltage after pressing compared to the cores manufactured using the comparative-example granules.

Moreover, the withstand voltage was further improved as the pressing pressure was higher in the cores manufactured using the predetermined composite particles (Examples). This confirms that Examples had a high consistency between pressing pressure and withstand voltage. This also confirms that Examples had a higher consistency between pressing pressure and withstand voltage compared to the cores manufactured using the comparative-example granules.

The reason why Examples had less variation in withstand voltage after pressing and a high consistency between pressing pressure and withstand voltage is probably that Examples used the predetermined composite particles of the present invention. In the composite particles of the present invention, as shown in FIG. 2 and FIG. 3, the binder was present as binder particles, and the binder particles were uniformly dispersed and attached on each of the large particles. Thus, it is conceivable that the large particles, the small particles, and the binder particles were kept uniformly dispersed even though the composite particles were put into the die and pressed. Then, it is conceivable that the dispersion state of the large particles, the small particles, and the binder particles contributed to the effects of less characteristic variation after pressing and high consistency between pressing pressure and withstand voltage.

On the other hand, as shown in FIG. 4, it is conceivable that the binder was unevenly attached on each of the large particles in Comparative Examples. Thus, it is conceivable that Comparative Examples were inferior to Examples in terms of characteristic variation after pressing and consistency between pressing pressure and withstand voltage.

Example 5

Except for changing the pressing pressure to 600 MPa and the pressing temperature to 50° C., rectangular-parallelepiped cores 6 were obtained to measure a withstand voltage as with Example 1. The results are shown in Table 3. In Example 5, a troidal core was obtained in addition to the rectangular-parallelepiped cores 6, and an initial permeability was also measured. The results are shown in Table 3. The troidal core was obtained in the following manner. The initial permeability was measured in the following manner.

Composite particles 2 obtained similarly to Example 1 were filled in a predetermined troidal die and pressed at 400 MPa (pressing pressure) to obtain a green compact of the core. The green compact of the manufactured core was subjected to a heat hardening treatment at 200° C. for five hours in the air to obtain a troidal core (outer diameter: 15 mm, inner diameter: 9 mm, thickness: 0.7 mm).

The troidal core was wound by a coil in 32 turns. Then, an initial permeability pi was measured by an LCR meter (LCR428A manufactured by HP).

Example 6

Except for changing the temperature of the die at pressing to 70° C., rectangular-parallelepiped cores and a troidal core were obtained to measure a withstand voltage and an initial permeability were measured as with Example 5. The results are shown in Table 3.

Example 7

Except for obtaining green compacts of rectangular-parallelepiped cores and a troidal core by pressing the cores at 200 MPa (pressing pressure) and 80° C. with Warm Isostatic Press (WIP), the rectangular-parallelepiped cores and the troidal core were obtained to measure a withstand voltage and an initial permeability as with Example 6. The results are shown in Table 3.

TABLE 3

| Sample No. | Pressing Pressure [MPa] | Withstand Voltage [V] | Initial Permeability |
|---|---|---|---|
| Example 5 | 600 | 0.07~0.4 | 25 |
| Example 6 | 600 | 0.12~0.50 | 26.5~30 |
| Example 7 | 200 | 0.96~2.13 | 25~29.5 |

Table 3 shows that the initial permeability was substantially the same between the unidirectional pressing (Examples 5 and 6) and the isotropical pressing (Example 7).

Table 3 also shows that the withstand voltage in the isotropical pressing (Example 7) was higher than that in the unidirectional pressing (Examples 5 and 6). This is probably because the rearrangement of the large particles and the small particles and the densification of internal organization were achieved in the isotropical pressing (WIP) (Example 7).

DESCRIPTION OF THE REFERENCE NUMERICAL

2 . . . inductor element
4 . . . winding part
5 . . . conductor
6 . . . core
12 . . . composite particle
14 . . . large particle
16 . . . binder particle
18, 18*a*, 18*b* . . . small particle
24 . . . cover part of large metal magnetic particle
28*a*, 28*b* . . . cover part of small metal magnetic particle
38*a*, 38*b* . . . connection point between small metal magnetic particle and large metal magnetic particle
46 . . . binder

What is claimed is:

1. A composite particle comprising:

a large particle having a particle size of 10 μm to 50 μm;

binder particles attached on the large particle and each having a particle size smaller than that of the large particle, and two or more small particles attached on the large particle and each having a particle size smaller than that of the large particle, wherein at least one of the binder particles is attached on the large particle and located between two small particles among the two or more small particles attached on the large particle, wherein the large particle is a magnetic particle, wherein the binder particles comprise thermosetting resin or thermoplastic resin, and wherein the small particles are magnetic particles.

2. The composite particle according to claim 1, wherein each of the binder particles has a particle size smaller than that of the small particles.

3. A core having a cross section or a surface on which the composite particle according to claim 1 is observed.

4. An inductor element comprising the core according to claim 3.

5. The composite particle according to claim 1, wherein each of (dL/dS), (dL/dB), and (dS/dB) satisfies the following relation, where dL is a particle size of the large particle, dS is a particle size of the small particle, and dB is a particle size of the binder particle:

$$1<(dL/dS)\leq 25,$$

$$1<(dL/dB)\leq 500, \text{ and}$$

$$0.6\leq(dS/dB)\leq 200.$$

6. The composite particle according to claim 5, wherein $$1.4\leq(dL/dS)\leq 8.3,$$

$$2\leq(dL/dB)\leq 25, \text{ and}$$

$$1.0\leq(dS/dB)\leq 7.0.$$

7. The composite particle according to claim 1, wherein at least a part of each of the large particles has a cover part formed thereon.

8. The composite particle according to claim 7, wherein the cover part is composed of TEOS, MgO, glass, resin, or a phosphate.

9. The composite particle according to claim 7, wherein at least a part of each of the small particles has a cover part formed thereon.

10. The composite particle according to claim 9, wherein the cover part of the large particle is composed of TEOS, and the cover part of the small particle is composed of MgO.

11. The composite particle according to claim 1, wherein at least a part of each of the small particles has a cover part formed thereon.

12. The composite particle according to claim 11, wherein the cover part is composed of MgO.

* * * * *